US010365585B1

(12) United States Patent
Sakurada

(10) Patent No.: US 10,365,585 B1
(45) Date of Patent: Jul. 30, 2019

(54) DEVELOPING APPARATUS AND IMAGE FORMING APPARATUS

(71) Applicant: KONICA MINOLTA, INC., Tokyo (JP)

(72) Inventor: Takumi Sakurada, Hachioji (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/043,726

(22) Filed: Jul. 24, 2018

(30) Foreign Application Priority Data

Aug. 22, 2017 (JP) ..... 2017-159552

(51) Int. Cl.

| | |
|---|---|
| ***G03G 15/08*** | (2006.01) |
| ***G03G 15/09*** | (2006.01) |
| ***G03G 15/095*** | (2006.01) |
| ***G03G 21/16*** | (2006.01) |
| ***G03G 21/18*** | (2006.01) |

(52) U.S. Cl.
CPC ..... *G03G 15/0896* (2013.01); *G03G 15/0889* (2013.01); *G03G 15/0891* (2013.01); *G03G 15/0898* (2013.01); *G03G 15/095* (2013.01); *G03G 15/0942* (2013.01); *G03G 21/1676* (2013.01); *G03G 21/1828* (2013.01); *G03G 2215/0802* (2013.01); *G03G 2215/0816* (2013.01); *G03G 2215/0819* (2013.01); *G03G 2215/0822* (2013.01); *G03G 2215/0836* (2013.01); *G03G 2215/0844* (2013.01); *G03G 2215/0847* (2013.01); *G03G 2215/0852* (2013.01); *G03G 2221/0021* (2013.01); *G03G 2221/0089* (2013.01)

(58) Field of Classification Search
CPC ..... G03G 15/0889; G03G 15/0891; G03G 15/0896; G03G 15/0898; G03G 15/0942; G03G 15/095; G03G 21/1676; G03G 21/1828; G03G 2215/0802; G03G 2215/0816; G03G 2215/0819; G03G 2215/0822; G03G 2215/0836; G03G 2215/0844; G03G 2215/0847; G03G 221/0852; G03G 2221/0021; G03G 2221/0089
See application file for complete search history.

(56) References Cited

U.S. PATENT DOCUMENTS 4,680,245 A * 7/1987 Suematsu ..... G03G 9/0918 428/404
6,215,974 B1 * 4/2001 Katoh ..... G03G 15/0875 399/258

(Continued)

FOREIGN PATENT DOCUMENTS

JP 2007206453 A 8/2007

*Primary Examiner* — Joseph S Wong
(74) *Attorney, Agent, or Firm* — Buchanan Ingersoll & Rooney PC

(57) ABSTRACT

A developing apparatus includes: a housing that accommodates developer and has a plurality of constituent parts; a vibrator that vibrates parts, which are two or more of the plurality of the constituent parts and to which scattered toner may adhere, as vibrated portions; an adjuster provided for at least one of the vibrated portions and the vibrator so as to adjust and match natural frequencies of the two or more of the vibrated portions; and a hardware processor that controls the vibrator.

17 Claims, 5 Drawing Sheets

(56) References Cited

U.S. PATENT DOCUMENTS

| | | | | |
|---|---|---|---|---|
| 8,824,935 | B2 * | 9/2014 | Seki | G03G 15/065 399/265 |
| 2009/0080941 | A1 * | 3/2009 | Nishiwaki | G03G 15/0856 399/254 |
| 2016/0282758 | A1 * | 9/2016 | Kawata | G03G 15/0865 |
| 2018/0120737 | A1 * | 5/2018 | Okamoto | G03G 15/0813 |

* cited by examiner

FIG. 4

| VIBRATED PORTION | ADJUSTER | NATURAL FREQUENCY [Hz] | VIBRATING PORTION | VIBRATION FREQUENCY [Hz] |
|---|---|---|---|---|
| FIRST MEMBER | FIRST ADJUSTMENT MEMBER | x | COMMON | x |
| SECOND MEMBER | SECOND ADJUSTMENT MEMBER | x | | |

DEVELOPING APPARATUS AND IMAGE FORMING APPARATUS

The entire disclosure of Japanese patent Application No. 2017-159552, filed on Aug. 22, 2017, is incorporated herein by reference in its entirety.

BACKGROUND

Technological Field

The present invention relates to a developing apparatus and an image forming apparatus.

Description of the Related Art

Generally, an image forming apparatus (a printer, a copying machine, a facsimile or the like) utilizing an electrophotographic process technology irradiates (exposes) an electrified photosensitive drum (image carrier) with laser light based on image data to form an electrostatic latent image. Then, toner is supplied to the photosensitive drum, on which the electrostatic latent image is formed, from a developing apparatus, thereby visualizing the electrostatic latent image to form a toner image. Moreover, after this toner image is directly or indirectly transferred onto a sheet, the toner image is formed on the sheet by heating and pressurizing with a fixing nip to fix.

In such an image forming apparatus, developer accommodated in a housing constituting the developing apparatus is supported by a developing sleeve (developer carrier). The developing sleeve supporting the developer conveys the toner toward the photosensitive drum while rotating. However, at this time, there is a case that the toner scatters due to the rotation of the developing sleeve. The scattered toner adheres to the upper wall and the like of the housing around the developing sleeve. When such toner accumulates, the toner aggregates and drops from the upper wall of the housing. When the dropped toner adheres to the developing sleeve and the photosensitive drum, for example, in the course of image forming processing, an image defect caused by the toner is likely to occur.

JP 2007-206453 A discloses a technology for dropping toner, which adheres to an upper wall of a housing constituting a developing apparatus, from the housing by vibrating the developing apparatus with attachment and detachment operation of the developing apparatus.

However, in the configuration in JP 2007-206453 A, since the developing apparatus is vibrated by the attachment and detachment operation of the developing apparatus, when the toner accumulated on the upper wall of the housing of the developing apparatus drops from the housing in the course of image forming processing until the developing apparatus is detached from an image forming apparatus, an image defect (toner spillage) due to the toner may still occur.

Moreover, since the developing apparatus is vibrated by the resilience of a spring, the vibration of the developing apparatus is attenuated by resistance such as the frictional force applied to the spring. Accordingly, the toner cannot be securely dropped from the housing in some cases, and the possibility of the occurrence of the toner spillage may increase.

SUMMARY

An object of the present invention is to provide a developing apparatus and an image forming apparatus capable of suppressing occurrence of an image defect caused by toner adhered to a housing of the developing apparatus.

To achieve the abovementioned object, according to an aspect of the present invention, a developing apparatus reflecting one aspect of the present invention comprises: a housing that accommodates developer and has a plurality of constituent parts; a vibrator that vibrates parts, which are two or more of the plurality of the constituent parts and to which scattered toner may adhere, as vibrated portions; an adjuster provided for at least one of the vibrated portions and the vibrator so as to adjust and match natural frequencies of the two or more of the vibrated portions; and a hardware processor that controls the vibrator.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 4 is a diagram showing one example of a correspondence relationship between a natural frequency and a vibration frequency.

DETAILED DESCRIPTION OF EMBODIMENTS

Figure 1:
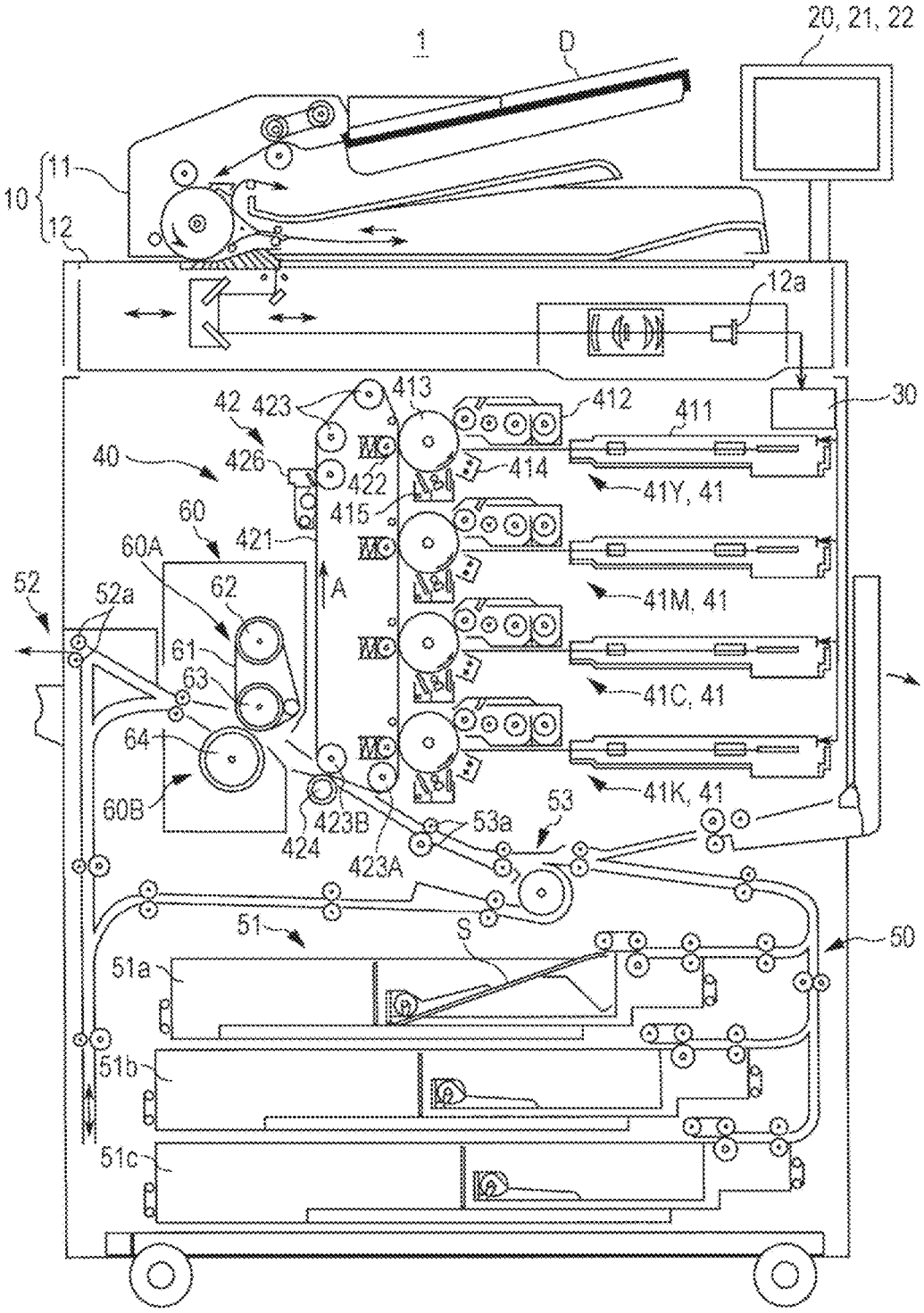
FIG. 1 is a diagram schematically showing the entire configuration of an image forming apparatus according to the present embodiment.
Figure 2:
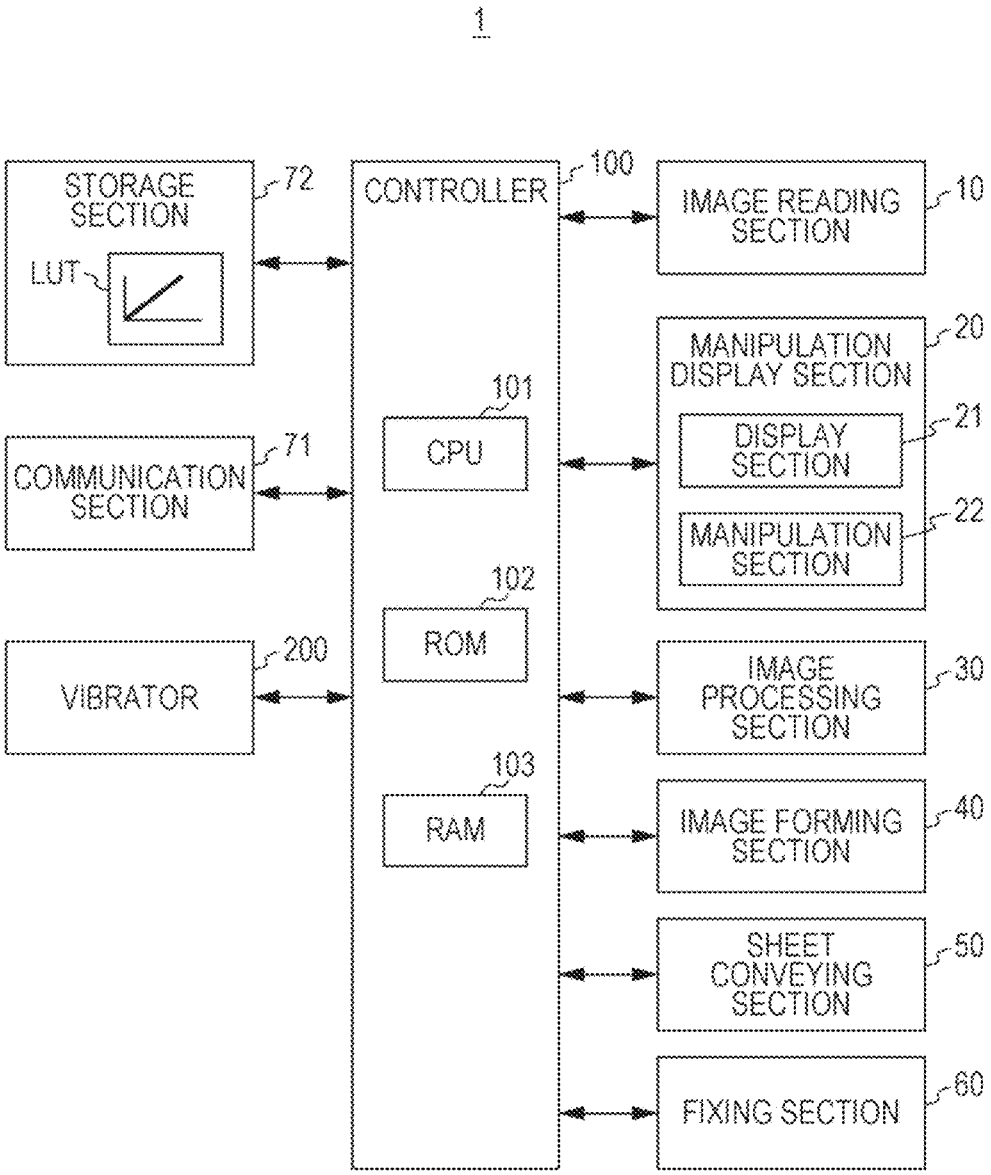
FIG. 2 is a diagram showing a main section of the control system of the image forming apparatus according to the present embodiment.

Hereinafter, the present embodiment will be described in detail with reference to the drawings. However, the scope of the invention is not limited to the disclosed embodiments. FIG. 1 is a diagram schematically showing the entire configuration of an image forming apparatus 1 according to the present embodiment. FIG. 2 is a diagram showing a main section of the control system of the image forming apparatus 1 according to the present embodiment.

The image forming apparatus 1 shown in FIGS. 1 and 2 is an intermediate transfer type color image forming apparatus utilizing an electrophotographic process technology. That is, the image forming apparatus 1 primarily transfers a toner image of each color of yellow (Y), magenta (M), cyan (C) and black (K) formed on a photosensitive drum 413 onto an intermediate transfer belt 421, superposes the toner images of the four colors on the intermediate transfer belt 421, and thereafter secondarily transfers the superposed image onto a sheet S, thereby forming an image.

Moreover, the image forming apparatus 1 adopts a tandem system, in which the photosensitive drums 413 for the four colors of Y, M, C and K are arranged in series in the running direction of the intermediate transfer belt 421, and the toner images of the respective colors are sequentially transferred onto the intermediate transfer belt 421 in a single procedure.

The image forming apparatus 1 includes an image reading section 10, a manipulation display section 20, an image processing section 30, an image forming section 40, a sheet conveying section 50, a fixing section 60 and a controller 100.

The controller 100 includes a central processing unit (CPU) 101, a read only memory (ROM) 102, a random access memory (RAM) 103 and the like. The CPU 101 reads out a program for the processing contents from the ROM 102, expands the program in the RAM 103, and centrally controls the operation of each block of the image forming apparatus 1 in cooperation with the expanded program. At this time, various data stored in a storage section 72 are referred. The storage section 72 is configured by, for example, a nonvolatile semiconductor memory (so-called flash memory) or a hard disk drive.

The controller 100 transmits/receives various data to/from an external apparatus (e.g., a personal computer) connected to a communication network, such as a local area network (LAN) or a wide area network (WAN), via a communication section 71. For example, the controller 100 receives image data (input image data) transmitted from the external apparatus and causes an image to be formed on the sheet S based on this image data. The communication section 71 is configured by, for example, a communication control card such as a LAN card.

The image reading section 10 is configured to include an automatic document feed apparatus 11 called an auto document feeder (ADF), a document image scanning apparatus 12 (scanner), and the like.

The automatic document feed apparatus 11 conveys a document D placed on a document tray by a conveying mechanism to be sent out to the document image scanning apparatus 12. Images (including ones on the both sides) on a large number of documents D placed on the document tray can be successively read at once by the automatic document feed apparatus 11.

The document image scanning apparatus 12 optically scans the document conveyed onto contact glass from the automatic document feed apparatus 11 or the document placed on the contact glass, irradiates a light receiving face of a charge coupled device (CCD) sensor 12*a* with the reflected light from the document, and reads the image on the document. The image reading section 10 generates input image data based on the reading result by the document image scanning apparatus 12. This input image data is subjected to predetermined image processing in the image processing section 30.

The manipulation display section 20 is configured by, for example, a liquid crystal display (LCD) with a touch panel and functions as a display section 21 and a manipulation section 22. The display section 21 displays various manipulation screens, image states, the operation status of each function, information on the inside of the image forming apparatus 1, and the like according to a display control signal inputted from the controller 100. The manipulation section 22 includes various manipulation keys such as a numeric keypad and a start key, accepts various input manipulations by a user, and outputs a manipulation signal to the controller 100.

The image processing section 30 includes a circuit that performs digital image processing on the input image data according to the initial setting or the user setting, and the like. For example, the image processing section 30 performs tone correction based on tone correction data (tone correction table) under the control of the controller 100. Besides the tone correction, the image processing section 30 also subjects the input image data to various correction processings such as color correction and shading correction, compression processing, and the like. The image forming section 40 is controlled based on the image data subjected to these processings.

The image forming section 40 includes image forming units 41Y, 41M, 41C and 41K for forming images of the respective colored toners of a Y component, an M component, a C component and a K component based on the input image data, an intermediate transfer unit 42, and the like.

The image forming units 41Y, 41M, 41C and 41K for the Y component, the M component, the C component and the K component have similar configurations. For convenience of illustration and explanation, common constituents are denoted by the same reference numerals, and Y, M, C or K is added to the reference numerals when the constituents are distinguished. In FIG. 1, only the constituents of the image forming unit 41Y for the Y component are denoted by reference numerals, and reference numerals of the constituents of the other image forming units 41M, 41C and 41K are omitted.

The image forming unit 41 includes an exposure apparatus 411, a developing apparatus 412, a photosensitive drum 413, an electrification apparatus 414, a drum cleaning apparatus 415, and the like.

For example, the photosensitive drum 413 is a negatively-charged organic photoconductor (OPC) in which an undercoat layer (UCL), a charge generation layer (CGL) and a charge transport layer (CTL) are sequentially laminated on the peripheral face of a conductive cylindrical body (rough aluminum tube) made of aluminum. The photosensitive drum 413 corresponds to an "image carrier" of the present invention.

The electrification apparatus 414 generates corona discharge, thereby uniformly and negatively electrifying the surface of the photosensitive drum 413 having photoconductivity.

The exposure apparatus 411 is configured by, for example, a semiconductor laser, and irradiates the photosensitive drum 413 with laser light for an image of each color component. A positive charge is generated at the charge generation layer of the photosensitive drum 413 and transported to the surface of the charge transport layer, thereby neutralizing the surface charge (negative charge) of the photosensitive drum 413. An electrostatic latent image of each color component is formed on the surface of the photosensitive drum 413 due to a potential difference with the surroundings.

The developing apparatus 412 is a two-component reversal type developing apparatus and visualizes the electrostatic latent image by adhering a toner of each color component to the surface of the photosensitive drum 413 to form a toner image. The developing apparatus 412 forms the toner image on the surface of the photosensitive drum 413 by supplying the toner contained in the developer to the photosensitive drum 413.

Figure 3:
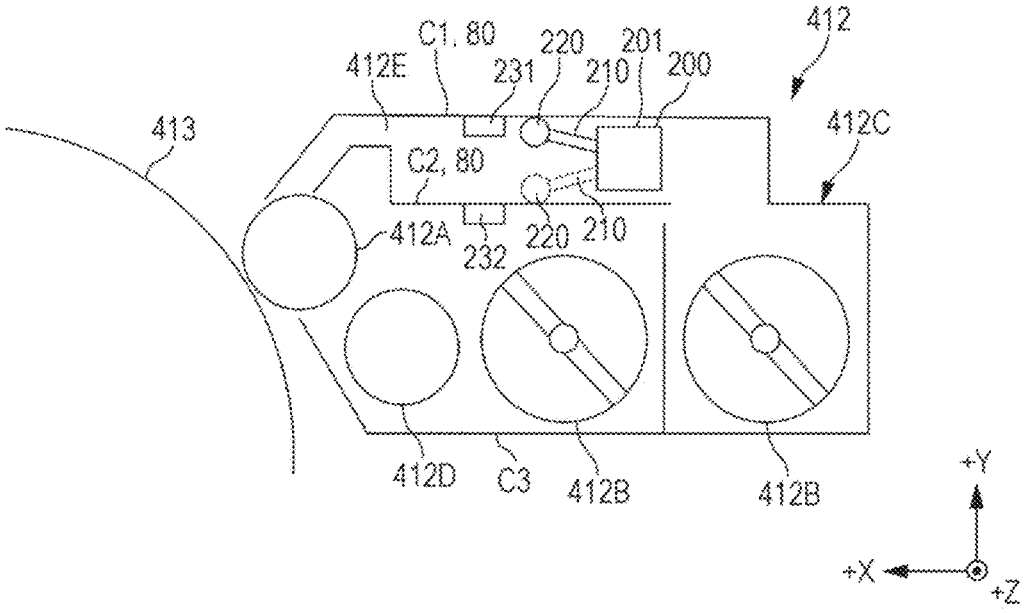
FIG. 3 is a side view schematically showing a developing apparatus to which a vibrator is attached.

The developing apparatus 412 is provided with a developing sleeve 412A, a stirring member 412B and a supply member 412D (see FIG. 3). The developing sleeve 412A supports the developer while rotating, and supplies the toner contained in the developer to the photosensitive drum 413. The stirring member 412B stirs the developer in the developing apparatus 412 by conveying the developer in the axial direction. The supply member 412D supplies the developer to the developing sleeve 412A from the stirring member 412B.

A housing 412C that accommodates the developer has a first member C1 which is a lid portion, a third member C3 which is a bottom portion, and a second member C2 which is a ceiling portion arranged therebetween. The first member C1, the second member C2 and the third member C3 correspond to "constituent parts" of the present invention.

The developing sleeve 412A, the stirring member 412B and the supply member 412D are arranged between the first member C1 and the third member C3. Moreover, a return passage 412E for returning the developer to the stirring member 412B side from the developing sleeve 412A side is provided between the first member C1 and the second member C2.

Moreover, as shown in FIGS. 2 and 3, the developing apparatus 412 is provided with a vibrator 200 for vibrating the developing apparatus 412. The vibrator 200 will be described later.

As shown in FIG. 1, the drum cleaning apparatus 415 has a drum cleaning blade in sliding contact with the surface of the photosensitive drum 413, and the like, and removes the transfer residual toner remaining on the surface of the photosensitive drum 413 after the primary transfer.

The intermediate transfer unit 42 includes the intermediate transfer belt 421, primary transfer rollers 422, a plurality of support rollers 423, a secondary transfer roller 424, a belt cleaning apparatus 426, and the like.

The intermediate transfer belt 421 is configured by an endless belt and stretched in a loop by the plurality of support rollers 423. At least one of the plurality of support rollers 423 is configured by a driving roller, and the other is configured by a driven roller. As the driving roller rotates, the intermediate transfer belt 421 runs at a constant speed in the direction of A. The intermediate transfer belt 421 is a belt having conductivity and elasticity, and is rotationally driven by a control signal from the controller 100.

The primary transfer rollers 422 are arranged on the inner peripheral face side of the intermediate transfer belt 421 so as to oppose the photosensitive drums 413 of the respective color components. Primary transfer nips for transferring the toner images onto the intermediate transfer belt 421 from the photosensitive drums 413 are formed by pressing the primary transfer rollers 422 against the photosensitive drums 413 with the intermediate transfer belt 421 sandwiched therebetween.

The secondary transfer roller 424 is arranged on the outer peripheral face side of the intermediate transfer belt 421 so as to oppose a backup roller 423B arranged on the downstream side of the belt running direction of the driving roller 423A. A secondary transfer nip for transferring the toner images onto the sheet S from the intermediate transfer belt 421 is formed by pressing the secondary transfer roller 424 against the backup roller 423B with the intermediate transfer belt 421 sandwiched therebetween.

The belt cleaning apparatus 426 removes the transfer residual toner remaining on the surface of the intermediate transfer belt 421 after the secondary transfer.

When the intermediate transfer belt 421 passes the primary transfer nips, the toner images on the photosensitive drums 413 are sequentially superposed and primarily transferred onto the intermediate transfer belt 421. Specifically, by applying a primary transfer bias to the primary transfer rollers 422 to give a charge with a polarity reverse to that of the toner to the back face side of the intermediate transfer belt 421, that is, the side which abuts the primary transfer rollers 422, the toner images are electrostatically transferred onto the intermediate transfer belt 421.

Thereafter, when the sheet S passes the secondary transfer nip, the toner images on the intermediate transfer belt 421 are secondarily transferred onto the sheet S. Specifically, by applying a secondary transfer bias to the backup roller 423B to give a charge with a polarity reverse to that of the toner to the front face side of the sheet S, that is, the side which abuts the intermediate transfer belt 421, the toner images are electrostatically transferred onto the sheet S.

The fixing section 60 includes an upper fixing section 60A, a lower fixing section 60B and the like. The upper fixing section 60A has fixing face side members arranged at a face side on which the toner images are formed, which is a fixing face of the sheet S, and the lower fixing section 60B has a back face side support member arranged at a face side opposite to the fixing face, which is a back face of the sheet S. By pressing the back face side support member against the fixing face side members, a fixing nip that sandwiches and conveys the sheet S is formed.

In the fixing section 60, the toner images are secondarily transferred, and the conveyed sheet S is heated and pressurized with the fixing nip, thereby fixing the toner images on the sheet S.

The upper fixing section 60A has an endless fixing belt 61, a heating roller 62 and a fixing roller 63, which are the fixing face side members. The fixing belt 61 is stretched by the heating roller 62 and the fixing roller 63.

The lower fixing section 60B has a pressure roller 64, which is the back face side support member. The fixing nip that sandwiches and conveys the sheet S is formed between the pressure roller 64 and the fixing belt 61.

The sheet conveying section 50 includes a paper feed section 51, a paper ejection section 52, a conveying path section 53, and the like. In three paper feed tray units 51*a* to 51*c* configuring the paper feed section 51, the sheets S (standard sheets, special sheets) distinguished based on basis weight, size or the like are accommodated by each preset type.

The conveying path section 53 has a plurality of pairs of conveying rollers such as a pair of registration rollers 53*a*, and the like. The sheets S accommodated in the paper feed tray units 51*a* to 51*c* are sent out one by one from the uppermost portion and conveyed to the image forming section 40 by the conveying path section 53. At this time, the inclination of the fed sheet S is corrected and the conveying timing is adjusted by the registration roller section in which the pair of the registration rollers 53*a* is disposed. Then, in the image forming section 40, the toner images on the intermediate transfer belt 421 are secondarily transferred onto one face of the sheet S collectively and subjected to a fixing step in the fixing section 60. The sheet S on which the image has been formed is ejected to the outside of the apparatus by the paper ejection section 52 including paper ejection rollers 52*a*.

Incidentally, there is a case where the toner scatters in the developing apparatus 412 due to the rotation of the developing sleeve 412A when the developing sleeve 412A supporting the developer conveys the toner toward the photosensitive drum 413. The scattered toner adheres to the upper wall (e.g., the first member C1 and the second member C2) of the housing 412C opposing the developing sleeve 412A. As the toner accumulates on the first member C1 and the second member C2, the toner aggregates and drops from the first member C1 and the second member C2. When the dropped toner adheres to the developing sleeve 412A and the photosensitive drum 413, for example, in the course of image forming processing, an image defect caused by the toner is likely to occur.

Thereupon, in the present embodiment, the first member C1 and the second member C2 to which the scattered toner adheres are vibrated portions. Generally, the natural frequencies of two or more vibrated portions differ from each other. If the natural frequencies coincide with each other, it is possible to vibrate two or more vibrated portions with a single vibration frequency. In the present embodiment, at least one of the vibrated portions and the vibrator is provided with an adjuster for adjusting the natural frequencies of the two or more vibrated portions. At the time of non-image formation in a state in which the housing 412C is mounted in the image forming apparatus 1, the controller 100 causes the vibrator 200 to vibrate the two or more vibrated portions with the single vibration frequency, and the toner accumulated on the vibrated portions is dropped from the upper wall of the housing 412C. This prevents the toner from dropping to the developing sleeve 412A and the photosensitive drum 413 in the course of the image forming processing. Thus, it is possible to suppress the occurrence of an image defect caused by the toner. Hereinafter, the vibrator 200 will be described.

FIG. 3 is a side view schematically showing the developing apparatus 412 to which the vibrator 200 is attached. Note that an X axis, a Y axis and a Z axis are drawn in FIG. 3. In the following description, the horizontal direction in FIG. 3 is referred to as an X direction, the left direction is referred to as a "+X direction," and the right direction is referred to as a "−X direction." Moreover, the vertical direction in FIG. 3 is referred to as a Y direction, the upward direction is referred to as a "+Y direction," and the downward direction is referred to as a "−Y direction." Furthermore, the direction perpendicular to the paper face in FIG. 3 is referred to as a Z direction, the forward direction is referred to as a "+Z direction," and the backward direction is referred to as a "−Z direction."

As shown in FIG. 3, the vibrator 200 is arranged in the return passage 412E provided between the first member C1 and the second member C2. That is, the vibrator 200 is arranged in the downward direction (−Y direction) of the first member C1 and in the upward direction (+Y direction) of the second member C2.

As shown in FIG. 3, the vibrator 200 has a main body 201, an arm portion 210 and a vibrating portion 220.

A direction changing mechanism (not shown) is provided in the main body 201. Note that a known means is used for the direction changing mechanism.

In FIG. 3, the arm portion 210 extending in the +Y direction from the main body 201 side in the +X direction is indicated by a solid line, and the arm portion 210 extending in the −Y direction from the main body 201 side in the +X direction is indicated by a dotted line.

The arm portion 210 is supported by the direction changing mechanism so that the extending direction thereof can be changed. One end portion of the arm portion 210 extends to the direction changing mechanism. The other end portion of the arm portion 210 supports the vibrating portion 220.

The vibrating portion 220 moves rotationally to a first vibration position indicated by the solid line in FIG. 3 together with the arm portion 210 and abuts the first member C1 (vibrated portion 80). On the other hand, the vibrating portion 220 moves rotationally to a second vibration position indicated by the dotted line in FIG. 3 together with the arm portion 210 and abuts the second member C2 (vibrated portion 80). That is, the vibrating portion 220 is provided so as to move rotationally between the first vibration position and the second vibration position by the direction changing mechanism.

The vibrating portion 220 may be any one that generates the vibration and conveys the vibration to the vibrated portions 80. For example, a small electric motor, an oscillator by electromagnetic induction, an oscillator utilizing a piezo effect, or the like is used for the vibrating portion 220. In the present embodiment, suppose that an electric motor is used for the vibrating portion 220. Note that one using an oscillator for the vibrating portion 220 will be described in a modification example.

The vibrating portion 220 converts the force in the rotational direction of the electric motor (not shown) into the force in the linear direction hitting the vibrated portions 80. Note that the electric motor is controlled such that the speed at which the vibrated portions 80 are hit corresponds to the natural frequencies of the vibrated portions 80.

In the present embodiment, a first adjuster 231 and a second adjuster 232 are provided to adjust the natural frequencies of the vibrated portions 80.

The first adjuster 231 is mounted to the first member C1. The first adjuster 231 adjusts the natural frequency of the first member C1 with a material selected from a plurality of types of materials. Note that the natural frequency of the vibrated portion integrally including the first adjuster 231 and the first member C1 is represented by the natural frequency x [Hz] of the first member C1 (see FIG. 4).

The second adjuster 232 is mounted to the second member C2. The second adjuster 232 adjusts the natural frequency of the second member C2 with a material selected from a plurality of types of materials. Note that the natural frequency of the vibrated portion integrally including the second adjuster 232 and the second member C2 is represented by the natural frequency y [Hz] of the second member C2 (see FIG. 4).

For example, ABS resin, PC-ABS resin, aluminum, steel or the like is used as the material of the first adjuster 231 and the second adjuster 232.

FIG. 4 is a diagram showing one example of a correspondence relationship between the natural frequency and the vibration frequency.

As shown in FIG. 4, the vibrating portion 220 vibrates with a vibration frequency x [Hz] (frequency equal to the natural frequency x [Hz] of the vibrated portions 80 (the first member C1 and the second member C2)) by the electric motor. As a result, the vibrating portion 220 vibrates the vibrated portions 80 with the vibration frequency x [Hz].

Next, the operation of the developing apparatus 412 in the present embodiment will be described.

At the time of non-image formation of the developing apparatus 412, the controller 100 controls the vibrator 200 to vibrate the first member C1 and the second member C2 (vibrated portions 80). Herein, the time of non-image formation is, for example, when the rotation of the developing sleeve 412A is stopped between jobs. Since the vibrated portions 80 are vibrated at the time of non-image formation of the developing apparatus 412 in this way, it is possible to securely drop the toner before the operation of the image forming processing starts in the developing apparatus 412. Therefore, it is possible to suppress the toner dropping from the vibrated portions 80 to the developing sleeve 412A and the photosensitive drum 413 in the course of the image forming processing.

Specifically, the controller 100 controls the direction changing mechanism to cause the vibrating portion 220 to abut the first member C1. In addition, the controller 100 causes the vibrating portion 220 to vibrate the first member C1 with the vibration frequency x [Hz]. Since the vibration frequency x [Hz] is equal to the natural frequency x [Hz] of the first member C1, the resonance of the first member C1 occurs.

Moreover, specifically, the controller 100 controls the direction changing mechanism to cause the vibrating portion 220 to abut the second member C2. In addition, the controller 100 causes the vibrating portion 220 to vibrate the second member C2 with the vibration frequency x [Hz]. Since the vibration frequency x [Hz] is equal to the natural frequency x [Hz] of the second member C2, the resonance of the second member C2 occurs.

Furthermore, the controller 100 vibrates the vibrated portions 80 according to the toner consumption amount of each color of Y, M, C and K. For example, the toner consumption amount of each color after the toner is dropped from the vibrated portions 80 is stored in an internal memory of the controller 100. When the toner consumption amount of the Y color is the largest among the toner consumption amounts of the respective colors, the controller 100 vibrates the vibrated portions 80 in the developing apparatus 412 for the Y color. The amount of toner adhered to the vibrated portions 80 increases according to the toner consumption amount, and the accumulated toner is likely to drop from the vibrated portions 80. Thereupon, the controller 100 vibrates the vibrated portions 80 according to the toner consumption amounts. Thus, it is possible to suppress the toner dropping from the vibrated portions 80 to the developing sleeve 412A and the photosensitive drum 413 in the course of the image forming processing.

According to the present embodiment as described above, included are the housing 412C having the first member C1, the second member C2 and the third member C3, the first adjuster 231 mounted to the first member C1, and the second adjuster 232 mounted to the second member C2, with the first member C1 and the second member C2 both serving as the vibrated portions 80. As described above, it is possible to vibrate the two or more vibrated portions 80 with the single vibration frequency. Accordingly, it is possible to securely drop the toner accumulated on the first member C1 and the second member C2 of the housing 412C of the developing apparatus 412. This prevents the toner from dropping to the developing sleeve 412A and the photosensitive drum 413 from the first member C1 and the like in the course of the image forming processing. Thus, it is possible to suppress the occurrence of an image defect caused by the toner.

Moreover, at the time of non-image formation of the developing apparatus 412, the controller 100 controls the vibrator 200 to vibrate the vibrated portions 80. Accordingly, it is possible to securely drop the toner before the operation of the image forming processing starts. Therefore, it is possible to suppress the toner dropping from the vibrated portions 80 to the developing sleeve 412A and the photosensitive drum 413 in the course of the image forming processing.

Figure 5:
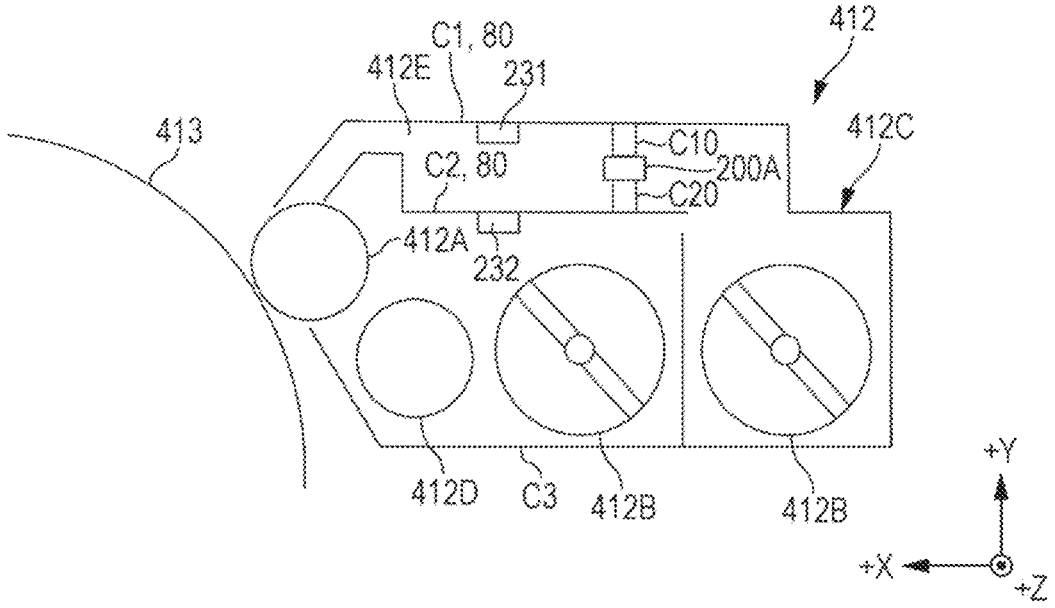
FIG. 5 is a side view schematically showing a developing apparatus according to a modification example.

Next, a modification example will be described. FIG. 5 is a view showing a vibrator 200A according to the modification example.

In the above embodiment, the small electric motor is used for the vibrator 200.

On the other hand, an oscillator by electromagnetic induction or an oscillator utilizing a piezo effect is used for the vibrator 200A according to the modification example.

Moreover, in the above embodiment, for example, the vibrating portion 220 is supported by the arm portion 210 and moves rotationally together with the arm portion 210 by the direction changing mechanism.

On the other hand, for example, the vibrator 200A according to the modification example is provided in a state being sandwiched between a member C10, which extends in the −Y direction from a first member C1, and a member C20, which extends in the +Y direction from a second member C2.

As described above, the vibrator 200A according to the modification example has an advantage that the vibrator 200A can be installed in a narrow space since the vibrator 200A has a simple configuration as compared with the above embodiment and can be miniaturized.

Furthermore, a vibrator according to another example includes a vibration source (not shown) and a transmission member (not shown) for conveying the vibration of the vibration source to the vibrating portion. For example, the vibrator is configured such that the vibration from the vibration source provided in a main body 201 is conveyed to a vibrating portion 220 through an arm portion 210 serving as transmission member.

Further, in the above embodiment, for example, a case where the controller 100 causes the vibrating portion 220 to vibrate the vibrated portions 80 is, for example, when the rotation of the developing sleeve 412A is stopped between the jobs. The present invention is not limited thereto. For example, the case may be at a non-stirring time when the developer accommodated in the housing 412C is not stirred by the stirring member 412B between sheets of a plurality of sheets in a case where an image is formed successively on the plurality of sheets. Accordingly, it is possible to securely drop the toner from the vibrated portions 80 before the operation of the image forming processing starts.

Moreover, in the above embodiment, the controller 100 causes the vibrator 200 to vibrate the first member C1 and the second member C2 nonsimultaneously. However, the present invention is not limited thereto. The controller 100 may cause the vibrator 200 to vibrate the first member C1 and the second member C2 simultaneously. Note that the vibrator 200 may have two arm portions 210 and two vibrating portions 220 supported by the ends of the arm portions in order to vibrate the first member C1 and the second member C2 simultaneously. By simultaneously vibrating the first member C1 and the second member C2, the toner accumulated on the first member C1 and the second member C2 can be dropped at once. Thus, the toner can be dropped quickly at the time of non-image formation.

Furthermore, the present invention is not limited thereto. For example, the controller 100 may cause the vibrator 200 to vibrate the first member C1 and the second member C2 in predetermined order. Accordingly, for example, it is possible to suppress the vibration sound generated at the time of vibrating to be low, as compared with the case of simultaneously vibrating the first member C1 and the second member C2.

Further, the controller 100 may cause the vibrator 200 to vibrate the first member C1 and the second member C2 separately. For example, there is a case where the toner accumulation amounts per hour are different between the first member C1 and the second member C2 even both being the upper walls of the housing 412C. Note that the toner accumulation amounts per hour are obtained by, for example, experimental results or simulation. The controller 100 vibrates the vibrated portions 80 (the first member C1 and the second member C2) according to the obtained toner accumulation amounts per hour.

Note that, in the above embodiment, the vibration frequency with which the vibrating portion 220 vibrates is set to a frequency equal to the natural frequency x of the first member C1 adjusted by the first adjuster 231 and set to a frequency equal to the natural frequency x of the second member C2 adjusted by the second adjuster 232. However, the present invention is not limited thereto. For example, the vibration frequency with which the vibrating portion 220 vibrates may be a frequency substantially equal to the natural frequency x as long as the frequency causes the resonance of the first member C1 and the second member C2.

Moreover, in the above embodiment, in order to match the natural frequency of the first member C1 and the natural frequency of the second member C2, the first adjuster 231 and the second adjuster 232 are mounted to the first member C1 and the second member C2. However, the present invention is not limited thereto. For example, the first adjuster 231 and the like may be mounted on the vibrator 200 side.

Furthermore, in the above embodiment, the vibrator 200 is arranged in the developing apparatus 412. However, the present invention is not limited thereto. For example, the vibrator 200 may be arranged outside the developing apparatus 412. For example, the vibrator 200 arranged outside the developing apparatus 412 vibrates such that the resonance of a vibrated portion occurs, with the housing 412C having a plurality of constituent parts, or a part, which is at least one of the plurality of constituent parts and to which the scattered toner may adhere, serving as the vibrated portion.

Although embodiments of the present invention have been described and illustrated in detail, the disclosed embodiments are made for purposes of illustration and example only and not limitation. The scope of the present invention should be interpreted by terms of the appended claims. That is, the present invention can be carried out in various forms without departing from the gist or the main features thereof.

What is claimed is:

1. A developing apparatus comprising:

a housing that accommodates developer and has a plurality of constituent parts;

a vibrator that vibrates parts, which are two or more of the plurality of the constituent parts and to which scattered toner may adhere, as vibrated portions;

an adjuster provided for at least one of the vibrated portions and the vibrator so as to adjust and match natural frequencies of the two or more of the vibrated portions; and a hardware processor that controls the vibrator.

2. The developing apparatus according to claim 1, wherein the adjuster adjusts the natural frequencies of the two or more vibrated portions with a material selected from a plurality of types of materials.

3. The developing apparatus according to claim 1, wherein the vibrator vibrates the two or more vibrated portions with a single vibration frequency.

4. The developing apparatus according to claim 1, wherein the vibrator has two or more vibrating portions respectively for the two or more vibrated portions.

5. The developing apparatus according to claim 4, wherein a hitting speed of the vibrating portions can be changed when the vibrated portions are vibrated by hitting the vibrated portions.

6. The developing apparatus according to claim 4, wherein the vibrating portions has an oscillator that converts an electric signal into mechanical vibration.

7. The developing apparatus according to claim 1, wherein the vibrator vibrates with a frequency substantially equal to a frequency with which resonance of the vibrated portions occurs.

8. The developing apparatus according to claim 1, wherein the hardware processor causes the vibrator to vibrate the vibrated portions at a time of non-image formation.

9. The developing apparatus according to claim 8, wherein the time of the non-image formation is a time at which rotation of a developing sleeve in the developing apparatus is stopped.

10. The developing apparatus according to claim 8, wherein the time of the non-image formation is between jobs.

11. The developing apparatus according to claim 8, wherein the time of the non-image formation is a non-stirring time when the developer accommodated in the housing is not stirred.

12. The developing apparatus according to claim 8, wherein the time of the non-image formation is between sheets of a plurality of sheets when an image is formed successively on the plurality of the sheets.

13. The developing apparatus according to claim 8, wherein a plurality of the developing apparatuses are respectively provided for a plurality of mutually different colors used for image formation, and the hardware processor causes the vibrator to vibrate the vibrated portions according to a toner consumption amount of each color.

14. The developing apparatus according to claim 8, wherein the hardware processor causes the vibrator to simultaneously vibrate the two or more vibrated portions.

15. The developing apparatus according to claim 8, wherein the hardware processor causes the vibrator to vibrate the two or more vibrated portions in predetermined order.

16. The developing apparatus according to claim 8, wherein the hardware processor causes the vibrator to vibrate the two or more vibrated portions separately.

17. An image forming apparatus comprising the developing apparatus according to claim 1.

* * * * *